US006139283A

United States Patent [19]

Ahn

[11] Patent Number: 6,139,283

[45] Date of Patent: Oct. 31, 2000

[54] VARIABLE CAPACITY SWASH PLATE TYPE COMPRESSOR

[75] Inventor: Hewnam Ahn, KyongNam, Rep. of Korea

[73] Assignee: Visteon Global Technologies, Inc., Dearborn, Mich.

[21] Appl. No.: 09/350,896

[22] Filed: Jul. 12, 1999

[51] Int. Cl.[7] ..... F04B 1/26

[52] U.S. Cl. ..... 417/222.2; 92/71

[58] Field of Search ..... 417/222.1, 222.2, 417/268, 270; 91/504, 505; 92/71, 72; 74/839

[56] References Cited

U.S. PATENT DOCUMENTS 5,517,900 5/1996 Kimura ..... 92/71

5,547,346 8/1996 Kanzaki ..... 417/222.2

*Primary Examiner*—Charles G. Freay

*Assistant Examiner*—William H Rodriguez

*Attorney, Agent, or Firm*—Larry I. Shelton

[57] ABSTRACT

A hinge mechanism is provided for a variable capacity swash plate type compressor. The swash plate type compressor includes a housing having a plurality of cylinder bores, a crank chamber, a suction chamber, and a discharge chamber. A rotor is mounted on and rotatably fixed to a drive shaft and includes a first portion of a hinge mechanism. A swash plate, including a second portion of the hinge mechanism, is operatively connected to the rotor via the hinge mechanism and slidably mounted on said drive shaft to thereby change an inclination angle thereof in response to changes of pressure in the crank chamber. The first portion of the hinge mechanism includes a pair of support arms protruding from the rotor toward the swash plate, each of the support arms having a guide groove, and the second portion includes an arm having one end extending from the swash plate, and a pin means supported by the other end of the arm. The guide groove is formed in an inside surface of each support arm in such a manner that the guide grooves are opposed in parallel to each other, and the pin means is arranged to be slidably engaged with the guide grooves at end portions thereof so as to guide a movement of the pin means in the guide grooves.

18 Claims, 3 Drawing Sheets

VARIABLE CAPACITY SWASH PLATE TYPE COMPRESSOR

FIELD OF THE INVENTION

The present invention relates to a variable capacity swash plate type compressor adapted for use in an air conditioning system for a vehicle, and more particularly to such compressor of an improved type which has a hinge mechanism for pivotally supporting a swash plate.

BACKGROUND OF THE INVENTION

In automotive air conditioners, a variable capacity swash plate type compressor is known, which generally comprises a drive shaft, a rotor or lug plate mounted on and rotating with the drive shaft, and a swash plate. The swash plate is rotatably disposed on a spherical outer surface of a spherical sleeve member slidably mounted on the drive shaft. The compressor also includes a plurality of pistons each engaged with the swash plate via semi-spherical shoes.

Between the rotor and the swash plate is arranged a hinge mechanism which normally includes a first arm member projecting from the rotor in the rear direction of the compressor, a second arm member projecting from the swash plate in the front direction of the compressor, and a pin member connecting the first and second arm members through a pair of holes each formed in the respective arm members. One of the holes, for example, the hole formed in the rotor is elongated to guide the pin therein according to the change of inclination angle of the swash plate. The sliding motion of the pin within the elongated hole allows the change of inclination angle of the swash plate.

The hinge mechanism allows the swash plate to slide along and change its inclination angle with respect to the drive shaft. The hinge mechanism also allows the swash plate to rotate together with the drive shaft and the rotor. Rotation of the drive shaft causes the rotor and swash plate to rotate therewith, and accordingly, each piston engaged with the swash plate reciprocates within respective cylinder bores so that suction and compression of the refrigerant gas are completed. The capacity of the compressor is controlled by changing the inclination angle of the swash plate according to the pressure difference between the pressure in the crank chamber and the suction pressure.

In the above described variable capacity swash plate type compressor, the swash plate rotates with the drive shaft and nutates back and forth with respect to the rotor, and the rotation of the swash plate is converted into the reciprocation of the pistons within the respective cylinder bores. A suction force acts on the swash plate from the pistons during the suction stroke while a compression reaction force also acts on the swash plate from the pistons during the compression stroke. Therefore, the swash plate is subjected to a twisting motion or bending moment due to the suction and compression reaction forces acting from each piston on the swash plate. Moreover, since a torque exerted by the drive shaft is transmitted to the swash plate through the hinge mechanism, the swash plate is twisted with respect to the rotor in a direction different from the back and forth nutating motion.

As a solution for the above mentioned problems, U.S. Pat. No. 5,540,559 discloses a variable capacity compressor having an improved hinge unit. The hinge units comprise a pair of brackets protruding from the back surface of the rotary swash plate, a pair of guide pins each having one end fixed to each bracket and the other end fixed to a spherical element, and a pair of support arms protruding from the upper front surface of the rotor. Each support arm is provided with a circular guide hole into which the spherical element of the guide pin is rotatably and slidably inserted. U.S. Pat. No. 5,336,056 discloses a hinge means including two support arms extended axially rearwardly from the rotary support. Each of the support arms has a through-bore in which a race member is fixedly seated to turnably receive a ball element. Each ball element, too, has formed therein a through-hole operative as a guide hole permitting an axial slide of a guide pin therein. The guide pins are fixedly press-fitted in two through-bores formed in the rotary drive element of the swash plate assembly, respectively.

However, the hinge mechanisms disclosed in the above U.S. Patents are complex, and in particular, they require precise and time-consuming machining to form the circular guide holes and spherical elements of the guide pins in U.S. Pat. No. 5,540,559 and to form through-bores in U.S. Pat. No. 5,336,056. Moreover, to make that assembly symmetrical, the hinge mechanism including two support arms protruding from the rotor or the rotary drive element must be accurate and therefore is relatively burdensome. These raise the cost in manufacturing the compressor. Therefore, it is advantageous to provide a compressor with a hinge mechanism which is simple in its construction and machining thereof and prevents the twisting and bending of the swash plate.

SUMMARY OF THE INVENTION

According to the present invention, there is provided a variable capacity swash plate type compressor. The swash plate type compressor comprises a housing having a cylinder block with a plurality of cylinder bores formed therein and enclosing therein a crank chamber, a suction chamber, and a discharge chamber. A drive shaft is rotatably supported by said housing, and a plurality of pistons are reciprocally disposed in each of said cylinder bores. A rotor is mounted on and rotatably fixed to said drive shaft so as to rotate together with said drive shaft in said crank chamber, with said rotor including a first portion of a hinge mechanism. A swash plate, including a second portion of the hinge mechanism, is operatively connected to said rotor via the hinge mechanism and slidably mounted on said drive shaft to thereby change an inclination angle thereof in response to changes of pressure in said crank chamber. Motion conversion means are disposed between said swash plate and said pistons for converting rotation of said swash plate into reciprocation of said pistons in the respective cylinder bores. Control valve means change the pressure in said crank chamber. Further, said first portion of said hinge mechanism includes a pair of support arms protruding from said rotor toward said swash plate, each of said support arms having a guide groove, and said second portion includes an bracket arm having one end extending from said swash plate, and a pin means supported by the other end of said arm; wherein, said guide groove is formed in an inside surface of each support arm in such a manner that the guide grooves are opposed in parallel to each other, and said pin means is arranged to be slidably engaged with the guide grooves at end portions thereof so as to guide a movement of said pin means in the guide grooves.

An object of the present invention is to provide a variable capacity swash plate type compressor provided with a novel hinge mechanism which can be easily and inexpensively manufactured.

An advantage of the present invention is, therefore, to provide a variable capacity swash plate type compressor which is free of the above-mentioned problems.

Other objects, features, and advantages of the present invention will be understood from the detailed description of the preferred embodiments of the present invention with reference to the accompanying drawings.

DETAILED DESCRIPTION OF THE PREFERRED EMBODIMENTS

Figure 1:
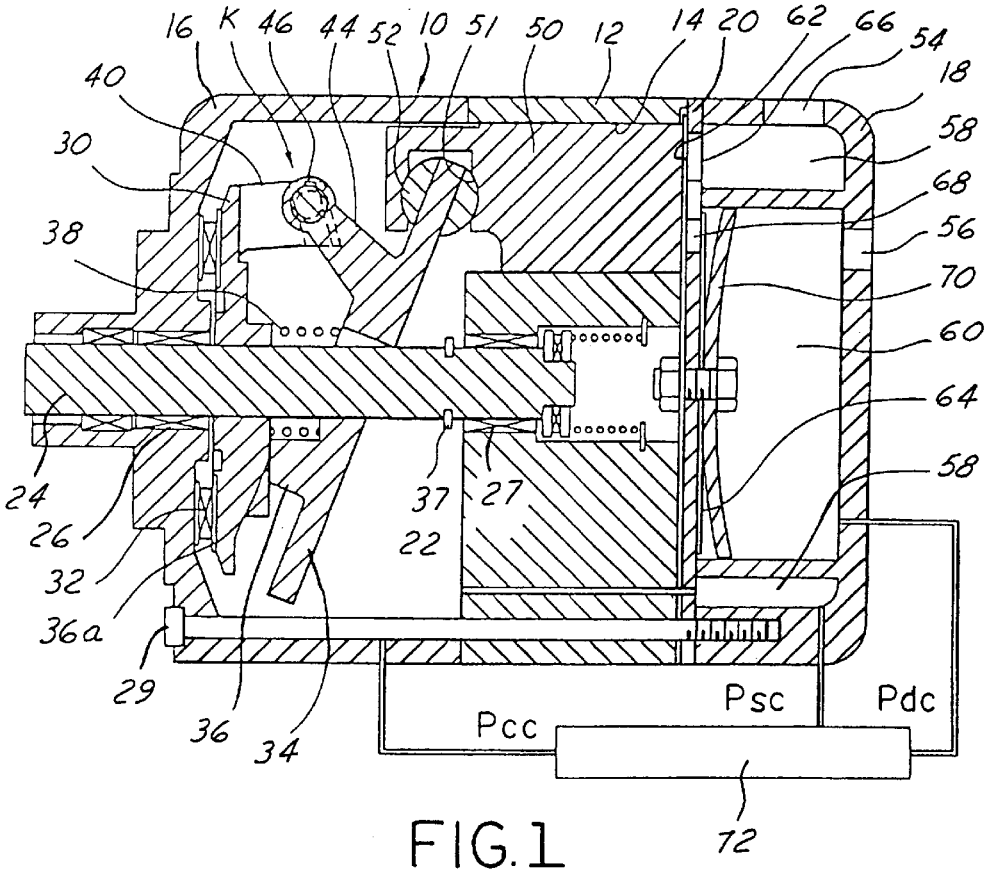
FIG. 1 is a longitudinal cross-sectional view of a variable capacity swash plate type compressor with a hinge means according to one embodiment of the present invention.

The preferred embodiment of the present invention will now be described with reference to FIGS. 1–4. A variable capacity swash plate type compressor 10 has a cylinder block 12 provided with a plurality of cylinder bores 14, a front housing 16 and a rear housing 18. Both front and rear ends of the cylinder block 12 are sealingly closed by the front housing 16 and rear housing 18, and a valve plate 20 is mounted between the cylinder block 12 and the rear housing 18. The cylinder block 12 and the front housing 16 define an air-tight sealed crank chamber 22. A drive shaft 24 is centrally arranged to extend through the front housing 16 to the cylinder block 12, and rotatably supported by radial bearings 26 and 27. The cylinder block 12 and the front and rear housings 16 and 18 are held together by screws 29.

A rotor 30 is fixedly mounted on the drive shaft 24 within the crank chamber 22 to be rotatable with the drive shaft 24, and supported by a thrust bearing 32 seated on an inner end of the front housing 16. A swash plate 34 is supported on the drive shaft 24. A spherical sleeve can be mounted between the drive shaft 24 and the swash plate 34 if so desired; and in this case, the swash plate 34 is rotatably supported on an outer surface of the spherical sleeve.

In FIG. 1, the swash plate 34 is shown in its maximum inclination angle position. A spring 38 is compressed and a stop surface 36*a* of a projection 36 is in contact with the rotor 30 so that a further increase of inclination angle of the swash plate 34 is prevented. On the other hand, for the swash plate in its minimum inclination angle position, not shown, the swash plate 34 is restricted by a stopper 37 provided on the drive shaft 24.

Figure 2:
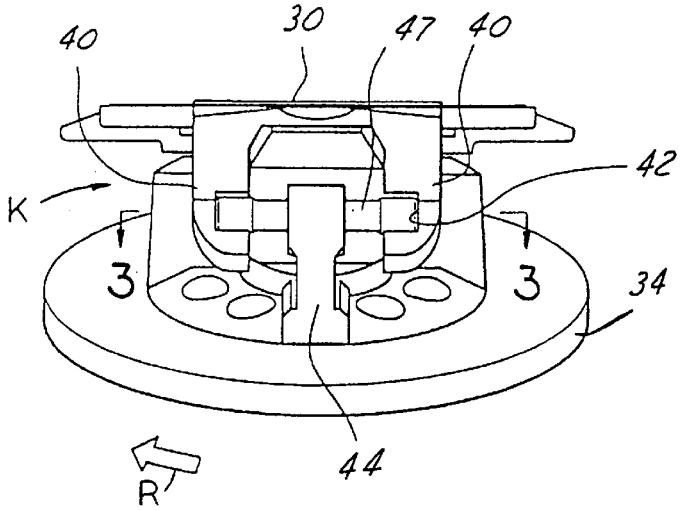
FIG. 2 a partial plan view showing the elements around a rotor in the compressor of FIG. 1.
Figure 3:
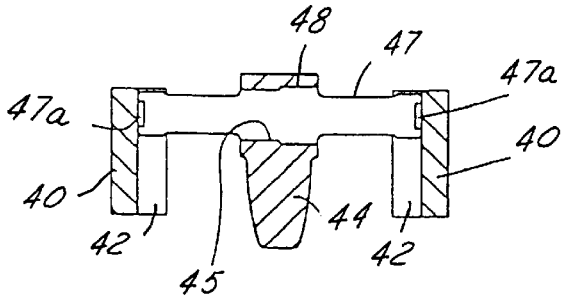
FIG. 3 is a partial cross-sectional view taken along the line A—A in FIG. 2.
Figure 4:
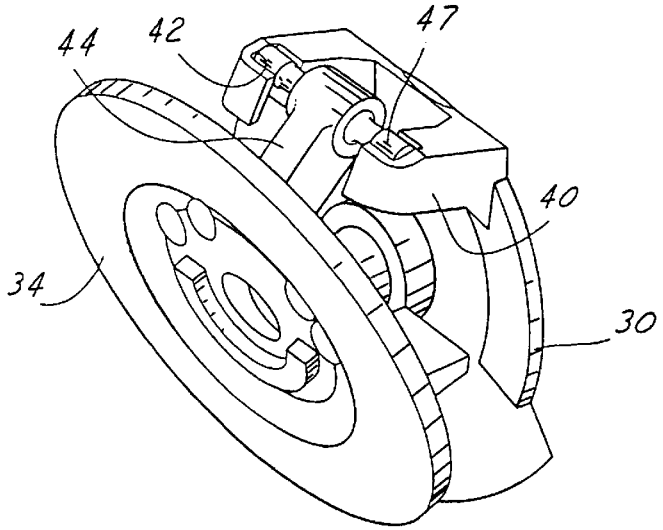
FIG. 4 is a perspective view showing the elements around a rotor in the compressor of FIG. 1.

As shown in FIGS. 2–4, a hinge mechanism designated by "K" includes a pair of support arms 40 protruding from an upper front surface of the rotor 30 in the rearward direction, an arm 44 protruding from an upper back surface of the swash plate 34 toward the support arms 40, and a cross pin 47 extending across the arm 44. A rectangular or arc shaped guide groove 42 to guide the movement of the cross pin 47 is linearly formed in an inside surface around a free end of each support arm 40 in such a manner that the two guide grooves 42 formed in each support arm are opposed to each other in a parallel relation. The guide grooves 42 are also arranged in such a manner that the guide grooves 42 are formed along the loci connecting a pair of predetermined positions, at which both ends of the cross pin 47 in the arm 44 come into contact with the inside surfaces of the support arms 40 when a corresponding piston 50 is positioned at its top dead center and the swash plate 34 is at its maximum inclination angle position, and another pair of predetermined positions, at which both ends of the cross pin 47 come into contact with the inside surfaces of the support arms 40 when a corresponding piston 50 is positioned at its top dead center and the swash plate 34 is at its minimum inclination angle position. In this manner, the support arms 40 are slidably connected to the arm 44 by the cross pin 47. In this construction, the drive shaft 24 is arranged so as to be remotely interposed between the two support arms 40 when viewing over the compressor 10.

In the above-described construction, the support arms 40 and arm 44 are formed in the rotor 30 and swash plate 34, respectively. But the support arms 40 and arm 44 may be reversed so that the support arms 40 are formed in the swash plate 34 and the arm 44 in the rotor 30.

The arm 44 has a stepped through-bore 45 into which the cross pin 47 is accommodated. A projection 48 extends from the cross pin 47 in response to the stepped through-bore 45, and when the cross pin 47 is press-fit into the arm 44, the stepped surfaces of the through-bore 45 and the projection 48 come into contact with one another around a center portion of the through-bore 45 so as to form a circular stop surface. Consequently, suction and compression reaction forces acting on the swash plate 34 via the pistons 50 are absorbed by the hinge mechanism "K", comprising the support arms 40, the arm 44 and the cross pin 47. At the same time, since a rotational force of the swash plate 34 also acts on the hinge mechanism "K", the rotational force of the swash plate 34 is applied to one or both sides of the cross pin 47 through the arm 44 (in FIG. 2, the left side with respect to the cross pin 47 when the swash plate 34 rotates in the direction of arrow R). The rotational force of the swash plate 34 generally may cause one of the two support arms 40 to be subject to more force than the other, and therefore, abnormal abrasion may occur in one side of the hinge mechanism "K". Accordingly, such a construction as the stepped through-bore 45 and the corresponding projection 48 of the cross pin 47 will prevent any abnormal abrasion.

Both end surfaces of the cross pin 47 are provided with depressions 47*a* (FIG. 3) to reduce the contact area between the guide grooves 42 of the support arms 40 and the cross pin 47 so as to make the change of inclination angle of the swash plate 34 easy by decreasing friction therebetween.

Through the hinge mechanism "K", the rotor 30 and the swash plate 34 are hinged to each other, and therefore, when the rotor 30 is rotated by rotation of the drive shaft 24, the swash plate 34 is also rotated. Movement of the cross pin 47 within the guide grooves 42 allows the swash plate 34 to slide along and incline with respect to the drive shaft 24. Namely, the inclination angle of the swash plate 34 is adjusted with respect to an imaginary plane perpendicular to the axis of the drive shaft 24.

As shown in FIG. 1, inner flat surfaces of semi-spherical shoes 52 come into contact with the outer peripheral portion of the swash plate 34, and outer semi-spherical surfaces of the shoes 52 are slidably engaged with shoe pockets 51, formed in the respective pistons 50. With this arrangement, a plurality of pistons 50 are engaged with the swash plate 34 via the shoes 52, and the pistons 50 reciprocate within the respective cylinder bores 14 in response to the rotation of the swash plate 34. That is, the shoes 52 serve as a motion conversion means for converting nutational motion of the swash plate 34 into reciprocation of each piston 50.

The rear housing 18 is provided with inlet and outlet ports 54 and 56, and divided into suction and discharge chambers 58 and 60. The valve plate 20 has suction and discharge ports 66 and 68. Each cylinder bore 14 is communicated with the suction chamber 58 and the discharge chamber 60 via the suction ports 66 and the discharge ports 68, respectively. Each suction port 66 is opened and closed by a suction valve 62, and each discharge port 68 is opened and closed by a discharge valve 64, in response to the reciprocal movement of the respective pistons 50. The opening motion of the discharge valve 64 is restricted by a retainer 70.

A control valve assembly 72 is in communication with the compressor 10 for adjusting a pressure level ($P_{CC}$) within the crank chamber 22, as shown in FIG. 1, by controlling communication with the pressure in the discharge chamber ($P_{dc}$) and/or the pressure in the suction chamber ($P_{sc}$).

Figure 9:
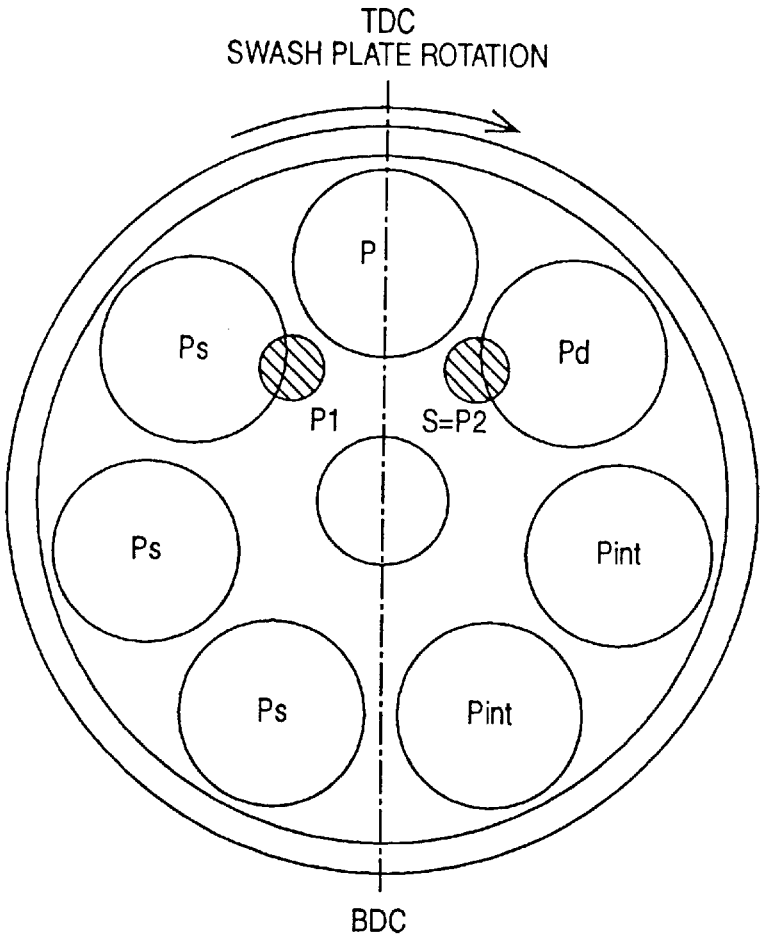
FIG. 9 shows a position on which the resultant of the suction and compression reaction forces acts on swash plate during suction and compression of a refrigerant gas.
Figure 10:
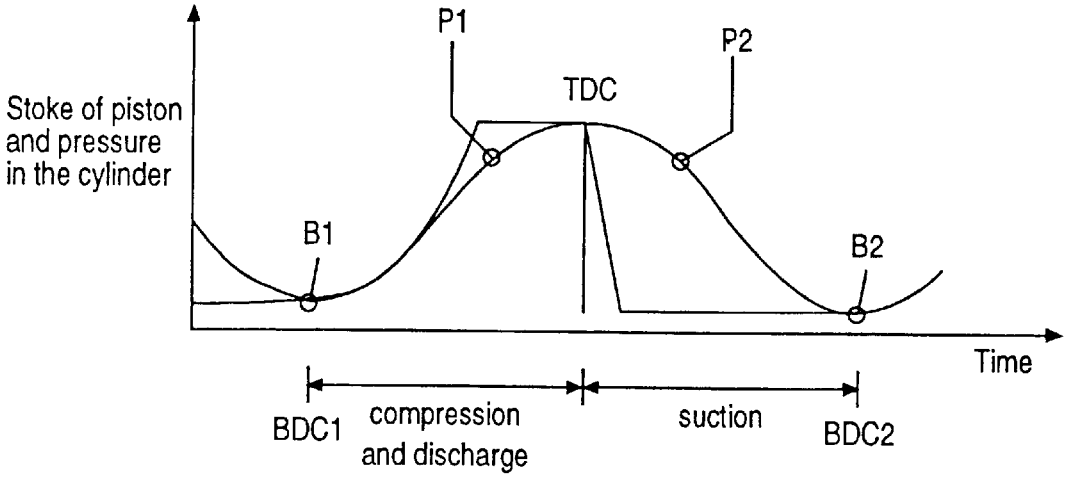
FIG. 10 is a diagram illustrating a relationship between the time, the position of a piston, and pressure in a cylinder.

Turning to FIGS. 9 and 10, the operating point of the resultant force of suction and compression reaction forces acting on the swash plate 34 is shifted from a position "P", at which the swash plate 34 is engaged with one of the pistons moved in its cylinder bore to the top dead center "TDC" thereof, to a position "S" in the rotational direction of the swash plate 34. When seven pistons, for example, reciprocate in the respective cylinder bores in response to the rotation of the swash plate 34, with respect to the rotational direction of the swash plate 34, compression reaction forces $P_d$ and $P_{int}$ act on the swash plate 34 in the right half portion thereof while suction forces $P_S$ act on the swash plate 34 in the left half portion thereof. At this time, the relation between the forces and their magnitude is $P_d > P_{int} > P_S$. As each of the pistons 50 approaches its top dead center "TDC" position during the reciprocation thereof, the discharge of the compressed refrigerant gas from the corresponding cylinder bore into the discharge chamber is completed. And when the movement of that piston is reversed from the top dead center "TDC" to the bottom dead center "B1", the suction of the refrigerant gas before compression is subsequently carried out for a time between the top dead center "TDC" and the bottom dead center "B1". Referring in particular to FIG. 10, when each of the pistons moves between the bottom dead center "B1" and the top dead center "TDC", the compression reaction force of the refrigerant gas acts on the swash plate, while as that piston moves between the top dead center "TDC" and the bottom dead center "B2", the suction force acts on the swash plate. Therefore, the resultant force of the compression and suction reaction forces applied to the swash plate via the pistons moves from the predetermined position "P" which lies on the center line of the swash plate 34, i.e., at which the swash plate 34 is engaged with the piston moved in its cylinder bore to the top dead center "TDC" thereof, to the position "S" with respect to the rotational direction of the swash plate. The broken lines designate the pressure level within each cylinder bore.

Referring now to FIGS. 9 & 10 in light of FIGS. 1–4, one of the two support arms 40 is disposed on a position P2 in the rotor 30, opposed to the position S, and the other of the support arms 40 is disposed on a position in the rotor 30 opposed to the position P1, while the arm 44 in the swash plate 34 is placed on the center line of the swash plate 34. Namely, a pair of hinge positions P1 and P2 are arranged symmetrically with respect to the plane passing through the predetermined position "P" of the swash plate 34 at which the swash plate 34 is engaged with the piston 50 moved in the corresponding cylinder bore 14 to the top dead center thereof. With this construction, the hinge mechanism K counteracts the moment (M, see FIG. 2) applied to the swash plate 34 and, therefore, prevents an excessive interference between the drive shaft 24 and the swash plate 34.

In the compressor having the above-described construction, when the drive shaft 24 is rotated, the swash plate 34 having a certain inclination angle is also rotated via the hinge mechanism K, and thus the rotation of the swash plate 34 is converted into the reciprocation of the pistons 50 within the respective cylinder bores 14 via the shoes 52. This reciprocating motion causes the refrigerant gas to be introduced from the suction chamber 58 of the rear housing 18 into the respective cylinder bores 14 in which the refrigerant gas is compressed by the reciprocating motion of the pistons 50. The compressed refrigerant gas is discharged from the respective cylinder bores 14 into the discharge chamber 60.

At this time, the capacity of the compressed refrigerant gas discharged from the cylinder bores 14 into the discharge chamber 60 is controlled by the control valve assembly 72 which adjustably changes the pressure level within the crank chamber 22. Namely, when the pressure level $P_{sc}$ in the suction chamber 58 is raised with increase of the thermal load of an evaporator, the control valve means 72 cuts off the refrigerant gas traveling from the discharge chamber 60 into the crank chamber 22 so that the pressure level $P_{cc}$ in the crank chamber 22 is lowered. When the pressure level in the crank chamber 22 is lowered, a back pressure acting on the respective pistons 50 is decreased, resulting in the angle of inclination of the swash plate 34 being increased. As the inclination angle changes, the cross pin 47 of the hinge mechanism K, which is in contact at both ends thereof within the guide grooves 42, slides along and in the guide grooves 42 of the support arms 40 toward the upper outer edge of the guide grooves 42. Accordingly, the swash plate 34 is moved in a forward direction against the force of the spring 38. Therefore, the angle of inclination of the swash plate 34 is increased, and as a result, the stroke of the respective pistons 50 is increased.

On the contrary, when the pressure level $P_{sc}$ in the suction chamber 58 is lowered with decrease of the thermal load of the evaporator, the control valve means 72 passes the compressed refrigerant gas of the discharge chamber 60 into the crank chamber 22. When the pressure level in the crank chamber 22 is raised, a back pressure acting on the respective piston 50 is increased, and therefore, the angle of inclination of the swash plate 34 is decreased. As the inclination angle changes, the cross pin 47 of the hinge mechanism K, in contact at both ends thereof with the guide grooves 42, slides along and in the guide grooves 42 of the support arms 40 toward the lower inner edge of the guide grooves 42. Accordingly, the swash plate 34 is moved in a reward direction yielding to the force of the spring 38. Therefore, the inclination angle of the swash plate 34 is decreased, and as a result, the stroke of the respective pistons 50 is shortened and the discharge capacity is decreased.

Referring to FIGS. 9 and 10 again, in the compressor with the above-described construction, during operation of the compressor, the suction force acts on about the left half portion of the swash plate 34 via the pistons 50. On the other hand, the compression reaction force acts on about the right half portion of the swash plate 34 via the pistons 50. Since one of the support arms 40 of the hinge mechanism K is disposed on the left position P1 with respect to the top dead center TDC and the other is disposed on the right position P2 with respect to the top dead center TDC, the suction and compression reaction forces are supported and absorbed by the hinge means of the support arms 40, arm 44 and cross pin 47. Therefore, the swash plate 34 can be prevented from being twisted around an axis perpendicular to the drive shaft 24 and from being subject to a bending moment around the above axis. Furthermore, both end surfaces of the cross pin 47 come into contact with the respective surfaces of the guide grooves 42 of the support arms 40, and therefore, abnormal abrasion of the surfaces of the guide grooves 42 due to application of the suction and compression reaction forces can be prevented as well.

FIGS. 5 to 8 illustrate a hinge mechanism adapted for use in a variable capacity swash plate type compressor as shown in FIG. 1 according to other embodiments of the present invention. In these embodiments, the construction of the hinge mechanism, in particular of the arm and the cross pin, is modified from that of the above-described embodiment in relation to FIGS. 1–4. The constructions of other portions of the compressor are the same as those of the above first embodiment, and like parts are designated by like numerals and explanation thereof is omitted hereinafter.

Figure 5:
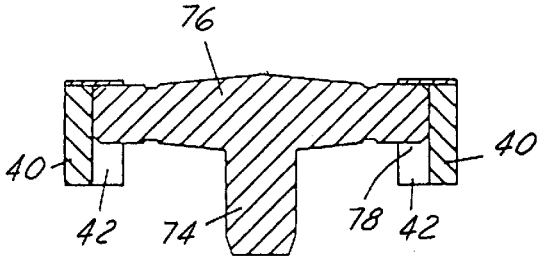
FIG. 5 is a partial cross-sectional view showing a hinge means for use in a variable capacity swash plate type compressor according to another embodiment of the present invention.

Turning now to FIG. 5, a hinge mechanism includes a pair of support arms 40 each having a guide groove 42, and a cross pin 76 formed integrally with an arm 74 of the swash plate. The cross pin 76 has a pair of cylindrical elements 78 formed at both ends thereof. The cylindrical elements 78 may have depressions formed in both end surfaces of the cross pin 76 (as shown in FIG. 3) to reduce the contact area between the guide grooves 42 of the support arms 40 and the cross pin 76.

Figure 6:
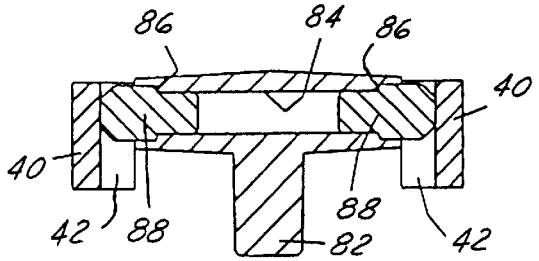
FIG. 6 is a partial cross-sectional view showing a hinge means for use in a variable capacity swash plate type compressor according to still another embodiment of the present invention.

Referring to FIG. 6, a hinge mechanism includes a pair of support arms 40 protruding from the rotor and having the guide grooves 42 formed in each support arm 40, and a T-shaped arm 82 protruding from the swash plate and having a cross portion extending between the guide grooves 42 and an upright portion. One end of the upright portion of the arm 82 is fixedly connected to the swash plate and the other is fixedly connected to the cross portion. The arm 82 has a through-bore 84 formed in the cross portion thereof, and a pair of stepped portions 86 are formed around the inner surface of the through-bore 84 near the ends of the cross portion of the arm 82. A pair of cylindrical pins 88 are press-fitted into the through-bore 84 at both ends of the cross portion of the arm 82, respectively. Each pin 88 has a head portion which comes into contact with the surface of the corresponding guide groove 42, and a body extending from the head portion and having a meter which is smaller than that of the head portion and comes into contact with the inner circumferential surface of the through-bore 84. Therefore, when each pin 88 is inserted into the through-bore 84, the adjoining portion of the head portion and body comes into contact with the inclined surface of the stepped portion 86 of the arm 82, and thus, a further insertion of the pin 88 toward the center of the through-bore 84 is restricted.

Figure 7A:
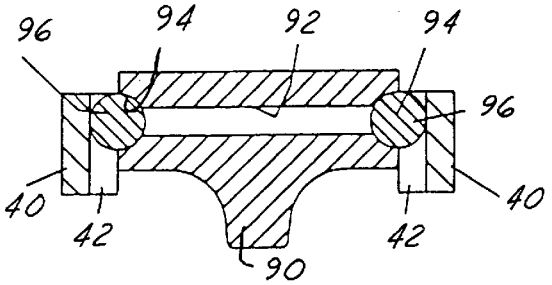
FIGS. 7*a* and 7*b* are partial cross-sectional views showing a hinge means for use in a variable capacity swash plate type compressor according to still another embodiment of the present invention.
Figure 7B:
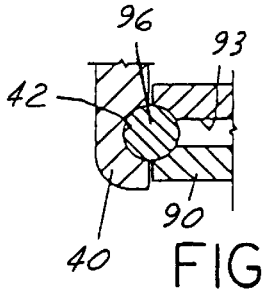

Turning now to FIGS. 7*a* and 7*b*, which illustrate a hinge mechanism adapted for use in a variable capacity compressor according to still another embodiment of the present invention. The hinge mechanism includes a pair of support arms 40 protruding from the rotor and having the rectangular guide grooves 42 formed in each support arm 40, and a T-shaped arm 90 protruding from the swash plate and having a cross portion extending between the guide grooves 42 and an upright portion. One end of the upright portion of the arm 90 is fixedly connected to the swash plate and the other is fixedly connected to the cross portion of the arm 90. The arm 90 has a through-bore 92 formed in the cross portion thereof, and a pair of semi-spherical pockets 94 formed at both ends of the cross portion of the arm 90. Each pocket 94 has disposed therein a ball element 96 which is slid upward and downward in the guide groove 42 in response to adjustment of the inclination angle of the swash plate and is rotatably in contact with the guide groove 42. The through-bore 92 may not be formed, but it is advantageous to form the through-bore 92 for the decrease of the mass and the easiness in machining the pockets 94. As shown in FIG. 7*b*, the guide grooves 42 of the support arms 40 can have semi-circular shape in cross section in response to the shape of the ball elements 96.

Figure 8:
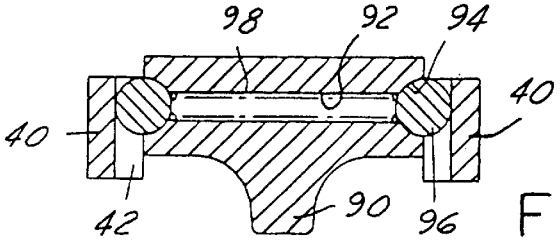
FIG. 8 is a partial cross-sectional view showing a hinge means for use in a variable capacity swash plate type compressor according to still another embodiment of the present invention.

Referring to FIG. 8, modified from that of FIG. 7*a*, the difference from the hinge mechanism of FIG. 7*a* is a coil spring 98 which is provided in the through-bore 92 so that noise due to a clearance between the pocket 94 and arm 90 and the ball element 96 is reduced, and force exerted on the respective ball elements 96 as the compressor operates is transferred between each ball via the coil spring 98 so as to disperse the force.

Although the present invention has been described in connection with the preferred embodiments, the invention is not limited thereto. It will be easily understood by those skilled in the art that variations and modifications can be easily made within the scope of the present invention as defined by the appended claims.

What is claimed is:

1. A variable capacity swash plate type compressor comprising:

a housing mechanism having a cylinder block with a plurality of cylinder bores formed therein and enclosing therein a crank chamber, a suction chamber, and a discharge chamber;

a drive shaft rotatably supported by said housing mechanism;

a plurality of pistons reciprocally disposed in each of said cylinder bores;

a rotor mounted on and rotationally fixed to said drive shaft so as to rotate together with said drive shaft in said crank chamber, said rotor including a first portion of a hinge mechanism;

a swash plate, including a second portion of the hinge mechanism, operatively connected to said rotor via the hinge mechanism and slidably mounted on said drive shaft to thereby change an inclination angle thereof in response to changes of pressure in said crank chamber;

motion conversion means disposed between said swash plate and said pistons for converting rotation of said swash plate into reciprocation of said pistons in the respective cylinder bores; and control valve means for changing pressure in said crank chamber, said first portion of said hinge mechanism including a pair of support arms protruding from said rotor toward said swash plate, each of said support arms having a guide groove, and said second portion including an bracket arm having one end extending from said swash plate, and a pin means supported by the other end of said bracket arm, wherein, said guide groove is formed in an inside surface of each support arm in such a manner that the guide grooves are opposed in parallel to each other, and said pin means is arranged to be slidably engaged with the guide grooves at end portions thereof so as to guide a movement of said pin means in the guide grooves.

2. The compressor of claim 1, wherein said guide grooves are arranged in an inside surface of each support arm in such a manner that said guide grooves are formed along loci connecting a pair of predetermined positions at which both ends of said pin means come into contact with said inside surfaces of said support arms when one of said pistons is positioned at its top dead center and the swash plate is in a maximum inclination angle position, and another pair of predetermined positions at which said both ends of said pin means come into contact with said inside surfaces of said support arms when said one of said pistons is positioned at its top dead center and said swash plate is in a minimum inclination angle position.

3. The compressor of claim 1, wherein one of said support arms is disposed on a corresponding position in said rotor opposed to an operating position on which a resultant force of suction and compression reaction forces applied to said swash plate act, and the other is disposed on a corresponding position in said rotor opposed to a position which, in turn, is opposed to said operating position, and wherein said bracket arm of said swash plate is disposed between said support arms.

4. The compressor of claim 1, wherein said bracket arm has a through-bore formed in said other end of said bracket arm, and said pin means comprises a pin extending between said guide grooves when press-fitted into said through-bore and being slidably engaged with said guide grooves at both end portions thereof.

5. The compressor of claim 4, wherein said bracket arm has a stepped portion formed around an inner circumferential surface of said through-bore, and said pin has a projection formed in response to said stepped portion so that when said swash plate is rotated, said stepped portion and said projection serve as a stopping means for preventing a rotational force of said swash plate from being excessively exerted in one direction on said hinge means.

6. The compressor of claim 1, wherein said pin means comprises a pin extending between said guide grooves to be slidably in contact with said guide grooves at both ends thereof, and wherein said bracket arm is formed integrally with said pin and said pin is supported by said other end of said bracket arm at a central portion thereof.

7. The compressor of claim 1, wherein said bracket arm comprises an upright portion, and a cross portion extending from said upright portion and further extending between said guide grooves, one end of said upright portion being fixedly connected to said swash plate and the other end being fixedly connected to said cross portion, wherein said bracket arm further comprises a through-bore formed in said cross portion of said bracket arm, and wherein said pin means comprises a pair of pins fitted into said through-bore from both ends of said cross portion, respectively, and being slidably in contact with said guide grooves at ends thereof.

8. The compressor of claim 7, wherein said bracket arm further comprises a pair of stepped portions formed around an inner circumferential surface of said through-bore, and wherein each pair of said pins has a head portion in slidable contact with the corresponding guide groove and a body extending from said head portion in such a manner that an adjoining portion of said head portion and body comes into contact with an inclined surface of said stepped portion.

9. The compressor of claim 1, wherein each of said guide grooves is rectangular.

10. A variable capacity swash plate type compressor comprising:

a housing having a cylinder block with a plurality of cylinder bores formed therein and enclosing therein a crank chamber, a suction chamber, and a discharge chamber;

a drive shaft rotatably supported by said housing;

a plurality of pistons reciprocally disposed in each of said cylinder bores;

a rotor mounted on and rotationally fixed to said drive shaft so as to rotate together with said drive shaft in said crank chamber, said rotor including a first portion of a hinge mechanism;

a swash plate, including a second portion of said hinge mechanism, operatively connected to said rotor via the hinge mechanism and slidably mounted on said drive shaft to thereby change an inclination angle thereof in response to changes of pressure in said crank chamber;

motion conversion means disposed between said swash plate and said pistons for converting rotation of said swash plate into reciprocation of said pistons in the respective cylinder bores; and control valve means for changing the pressure in said crank chamber, said second portion of said hinge mechanism including a pair of support arms protruding from said swash plate toward said rotor, each of said support arms having a guide groove, and said first portion including an arm having one end extending from said rotor, and a pin means supported by the other end of said arm, wherein, said guide groove is formed in an inside surface of each support arm in such a manner that the guide grooves are opposed in parallel to each other, and said pin means is arranged to be slidably engaged with the guide grooves at end portions thereof so as to guide a movement of said pin means in the guide grooves.

11. The compressor of claim 10, wherein said guide grooves are arranged in said inside surface of each support arm in such a manner that said guide grooves are formed along loci connecting a pair of predetermined positions at which both ends of said pin means come into contact with inside surfaces of said support arms when one of said pistons is positioned at its top dead center and the swash plate is in a maximum inclination angle position, and another pair of predetermined positions at which said both ends of said pin means come into contact with inside surfaces of said support arms when said one of said pistons is positioned at its top dead center and said swash plate is in a minimum inclination angle position.

12. The compressor of claim 10, wherein one of said support arms is disposed in said swash plate on an operating position on which a resultant force of suction and compression reaction forces applied to said swash plate acts, and the other is disposed on a position opposed to said operating position, and wherein said bracket arm of said rotor is disposed between said support arms.

13. The compressor of claim 10, wherein said bracket arm has a through-bore formed in said other end of said bracket arm, and said pin means comprises a pin extending between said guide grooves when press-fitted into said through-bore and being slidably engaged with said guide grooves at both end portions thereof.

14. The compressor of claim 13, wherein said bracket arm has a stepped portion formed around a inner circumferential surface of said through-bore, and said pin has a projection formed in response to said stepped portion so that when said swash plate is rotated, said stepped portion and said projection serve as a stopping means for preventing a rotational force of said swash plate from being excessively exerted in one direction on said hinge means.

15. A variable capacity swash plate type compressor comprising:

a housing having a cylinder block with a plurality of cylinder bores formed therein and enclosing therein a crank chamber, a suction chamber, and a discharge chamber;

a drive shaft rotatably supported by said housing;

a plurality of pistons reciprocally disposed in each of said cylinder bores;

a rotor mounted on and rotatably fixed to said drive shaft so as to rotate together with said drive shaft in said crank chamber, said rotor including a first portion of a hinge mechanism;

a swash plate, including a second portion of a hinge mechanism, operatively connected to said rotor via the hinge mechanism and slidably mounted on said drive shaft to thereby change an inclination angle thereof in response to changes of pressure in said crank chamber;

motion conversion means disposed between said swash plate and said pistons for converting rotation of said swash plate into reciprocation of said pistons in the respective cylinder bores; and control valve means for changing the pressure in said crank chamber, said first portion of said hinge mechanism including a pair of support arms protruding from said rotor toward said swash plate, each of said support arms having a guide groove, said second portion of said hinge mechanism including a T-shaped arm protruding from said swash plate and having an upright portion and a cross portion extending between the guide grooves in a direction across said upright portion, one end of said upright portion being fixedly connected to said swash plate and the other end of said upright portion being connected to said cross portion, a pair of semi-spherical pockets formed at both ends of said cross portion, and a pair of ball elements disposed in the respective pockets, wherein, said guide groove is formed in an inside surface of each support arm in such a manner that the guide grooves are opposed in parallel to each other, and said ball elements are arranged to be slidable upward and downward in said guide grooves in response to adjustment of the inclination angle of said swash plate and are rotatably in contact with said guide grooves.

16. The compressor of claim 15, wherein said guide grooves are arranged in said inside surface of each support arm in such a manner that said guide grooves are formed along loci connecting a pair of predetermined positions, at which both ends of said pin means come into contact with inside surfaces of said support arms when one of said pistons is positioned at its top dead center and the swash plate is in a maximum inclination angle position, and another pair of predetermined positions at which said both ends of said pin means come into contact with inside surfaces of said support arms when said one of said pistons is positioned at its top dead center and said swash plate is in a minimum inclination angle position.

17. The compressor of claim 15, wherein one of said support arms is disposed on a corresponding position in said rotor opposed to an operating position on which a resultant force of suction and compression reaction forces applied to said swash plate acts, and the other is disposed on a corresponding position in said rotor opposed to a position which, in turn, opposed to said operating position, and wherein said T-shaped arm of said swash plate is disposed between said support arms.

18. The compressor of claim 15, wherein said T-shaped arm further comprises a through-bore formed in said cross portion, and a spring means disposed in said through-bore to be in contact with said ball elements disposed in said pockets.

* * * * *